US007340838B2

(12) United States Patent
Onion

(10) Patent No.: US 7,340,838 B2
(45) **Date of Patent: *Mar. 11, 2008**

(54) FOLDING KNIFE WITH SAFETY LOCK

(75) Inventor: Kenneth J. Onion, Kaneohe, HI (US)

(73) Assignee: KAI U.S.A., Ltd., Tualatin, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/463,232

(22) Filed: Jun. 16, 2003

(65) Prior Publication Data

US 2004/0088865 A1 May 13, 2004

Related U.S. Application Data

(63) Continuation of application No. 09/904,194, filed on Jul. 12, 2001, now Pat. No. 6,591,504.

(51) Int. Cl.
*B26B 1/02* (2006.01)

(52) U.S. Cl. ..... 30/159; 30/160

(58) Field of Classification Search ..... 30/160, 30/159, 158, 155, 161, 156, 157
See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Belcher |
| 226,910 | A | 4/1880 | Friebertshauser |
| 338,251 | A | 3/1886 | Crandall et al. |
| 530,792 | A | 12/1894 | Nordlow |
| 551,052 | A | 12/1895 | Shonnard et al. |
| 552,928 | A | 1/1896 | Russell |
| 557,760 | A | 4/1896 | Brauer |
| 577,593 | A | 2/1897 | Bronson |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 1,189,005 | A | 6/1916 | Seely |
| 1,315,503 | A | 9/1919 | Hughes |

(Continued)

FOREIGN PATENT DOCUMENTS

| | | |
|---|---|---|
| DE | 28765 | 1/1884 |

(Continued)

OTHER PUBLICATIONS

Civil Docket for Case #:3:05-cv-00446-HA.

(Continued)

*Primary Examiner*—Hwei-Siu C. Payer
(74) *Attorney, Agent, or Firm*—Seed IP Law Group PLLC

(57) ABSTRACT

A folding knife having a safety lock moveably mounted on a handle of the knife. The safety lock may slide to a locking position to prevent the blade from opening out of the handle by obstructing the path of the blade as the blade is urged from a closed position to an open position. The safety lock also may slide away from the locking position, in which the safety lock does not obstruct the path of the blade.

18 Claims, 4 Drawing Sheets

U.S. PATENT DOCUMENTS

| | | | | |
|---|---|---|---|---|
| 1,319,532 | A | 10/1919 | Rasmussen | |
| 1,357,398 | A | 11/1920 | Haywood | |
| 1,412,373 | A | 4/1922 | Shields | |
| 1,440,793 | A | 1/1923 | Rasmussen | |
| 1,454,665 | A | 5/1923 | Bobek | |
| 1,515,688 | A | 11/1924 | Love | |
| 1,584,165 | A | 5/1926 | Brown | |
| 1,603,914 | A | 10/1926 | Hermann | |
| 1,614,949 | A | 1/1927 | Finley | |
| 1,701,027 | A | 2/1929 | Brown | |
| 1,743,022 | A | 1/1930 | Carman | |
| 1,810,031 | A | 6/1931 | Schrade | |
| 1,864,011 | A | 6/1932 | Brown | |
| 2,286,524 | A | 6/1942 | Wilbur | |
| 2,407,897 | A | 9/1946 | Newman | |
| 2,736,959 | A | 3/1956 | Simon et al. | |
| 3,079,784 | A | 3/1963 | Pavlowski | |
| 3,404,456 | A | 10/1968 | Chilko | |
| 3,829,967 | A | 8/1974 | Gilbert | |
| 3,868,774 | A | 3/1975 | Miori | |
| 4,040,181 | A | 8/1977 | Johnson | |
| 4,133,106 | A | 1/1979 | Addis | |
| 4,148,140 | A | 4/1979 | Lile | |
| 4,173,068 | A | 11/1979 | Cargill | |
| 4,218,819 | A | 8/1980 | Phelps | |
| 4,240,201 | A | 12/1980 | Sawby et al. | |
| 4,268,960 | A | 5/1981 | Reinschreiber | |
| 4,274,200 | A | 6/1981 | Coder | |
| 4,322,885 | A | 4/1982 | Osada | |
| 4,347,665 | A | 9/1982 | Glesser | |
| 4,356,631 | A | 11/1982 | Guth | |
| 4,404,748 | A | 9/1983 | Wiethoff | |
| 4,439,922 | A | 4/1984 | Sassano | |
| 4,442,600 | A | 4/1984 | Felix-Dalichow | |
| 4,451,982 | A | 6/1984 | Collins | |
| 4,502,221 | A | 3/1985 | Pittman | |
| 4,541,175 | A | 9/1985 | Boyd et al. | |
| 4,570,341 | A | 2/1986 | Konneker | |
| 4,604,803 | A | 8/1986 | Sawby | |
| 4,612,706 | A | 9/1986 | Yunes | |
| 4,670,984 | A | 6/1987 | Rickard | |
| 4,719,700 | A | 1/1988 | Taylor, Jr. | |
| 4,741,106 | A | 5/1988 | Yamagishi | |
| 4,776,094 | A | 10/1988 | Glesser | |
| 4,802,279 | A | 2/1989 | Rowe | |
| 4,805,303 | A | 2/1989 | Gibbs | |
| 4,811,486 | A | 3/1989 | Cunningham | |
| 4,837,932 | A | 6/1989 | Elsener | |
| 4,893,409 | A | 1/1990 | Poehlmann | |
| 4,896,424 | A | 1/1990 | Walker | |
| 4,947,552 | A | 8/1990 | Barnes | |
| 4,974,323 | A | 12/1990 | Cassady | |
| 4,979,301 | A | 12/1990 | Walker | |
| 5,044,079 | A | 9/1991 | Gibbs | |
| 5,060,379 | A | 10/1991 | Neely | |
| 5,092,045 | A | 3/1992 | Boyd, Jr. et al. | |
| 5,095,624 | A | 3/1992 | Ennis | |
| 5,111,581 | A | 5/1992 | Collins | |
| 5,131,149 | A | 7/1992 | Thompson et al. | |
| D333,251 | S | 2/1993 | Glesser | |
| D336,602 | S | 6/1993 | Thompson et al. | |
| D345,289 | S | 3/1994 | Sakai | |
| 5,293,690 | A | 3/1994 | Cassady | |
| D347,375 | S | 5/1994 | Sakai | |
| 5,325,588 | A | 7/1994 | Rogers | |
| 5,331,741 | A | 7/1994 | Taylor, Jr. | |
| 5,400,509 | A | 3/1995 | Collins | |
| 5,425,175 | A | 6/1995 | Rogers | |
| 5,437,101 | A | 8/1995 | Collins | |
| 5,461,786 | A | 10/1995 | Miller | |
| D365,266 | S | 12/1995 | Hasegawa | |
| D366,408 | S | 1/1996 | Sessions et al. | |
| 5,493,781 | A | 2/1996 | Saito | |
| 5,502,895 | A | 4/1996 | Lemaire | |
| 5,511,310 | A | 4/1996 | Sessions et al. | |
| 5,515,610 | A | 5/1996 | Levin et al. | |
| 5,537,750 | A | 7/1996 | Seber et al. | |
| 5,546,662 | A | 8/1996 | Seber et al. | |
| D373,716 | S | 9/1996 | Keys et al. | |
| 5,581,895 | A | 12/1996 | Jeffcoat | |
| 5,596,808 | A | 1/1997 | Lake et al. | |
| D377,744 | S | 2/1997 | Hasegawa | |
| 5,615,484 | A | 4/1997 | Pittman | |
| 5,647,129 | A | 7/1997 | Stamper | |
| D384,871 | S | 10/1997 | McWillis | |
| 5,685,079 | A | 11/1997 | Brothers et al. | |
| 5,689,885 | A | 11/1997 | Walston | |
| 5,692,304 | A | 12/1997 | Campbell | |
| 5,699,615 | A | 12/1997 | Chen | |
| D389,718 | S | 1/1998 | Wegner | |
| D392,538 | S | 3/1998 | Buck et al. | |
| D392,539 | S | 3/1998 | Balolia | |
| 5,737,841 | A | 4/1998 | McHenry et al. | |
| 5,755,035 | A | 5/1998 | Weatherly | |
| 5,781,998 | A | 7/1998 | Stamper | |
| 5,802,722 | A | 9/1998 | Maxey et al. | |
| D399,113 | S | 10/1998 | Balolia | |
| 5,815,927 | A * | 10/1998 | Collins | 30/161 |
| 5,819,414 | A | 10/1998 | Marifone | |
| 5,822,866 | A | 10/1998 | Pardue | |
| 5,826,340 | A | 10/1998 | Hull | |
| 5,839,194 | A | 11/1998 | Bezold | |
| 5,845,404 | A | 12/1998 | Jeffcoat | |
| D407,003 | S | 3/1999 | Macowski et al. | |
| 5,875,552 | A | 3/1999 | Chen | |
| 5,887,347 | A | 3/1999 | Gibbs | |
| 5,964,036 | A | 10/1999 | Centofante | |
| 5,966,816 | A | 10/1999 | Roberson | |
| 6,079,106 | A | 6/2000 | Vallotton | |
| 6,122,829 | A | 9/2000 | McHenry et al. | |
| 6,125,543 | A | 10/2000 | Jhones | |
| 6,145,202 | A | 11/2000 | Onion | |
| D434,631 | S | 12/2000 | Lum | |
| 6,154,965 | A | 12/2000 | Sakai | |
| 6,158,127 | A | 12/2000 | Taylor | |
| D438,085 | S | 2/2001 | Onion | |
| 6,256,888 | B1 | 7/2001 | Shuen | |
| 6,276,063 | B1 | 8/2001 | Chen | |
| 6,289,592 | B1 | 9/2001 | Emerson | |
| 6,308,420 | B1 | 10/2001 | Moser | |
| 6,338,431 | B1 | 1/2002 | Onion | |
| 6,378,214 | B1 | 4/2002 | Onion | |
| 6,397,477 | B1 | 6/2002 | Collins | |
| 6,427,334 | B2 | 8/2002 | Onion | |
| 6,427,335 | B1 | 8/2002 | Ralph | |
| 6,430,816 | B2 | 8/2002 | Neveux | |
| 6,434,831 | B2 | 8/2002 | Chen | |
| 6,438,848 | B1 | 8/2002 | McHenry et al. | |
| 6,490,797 | B1 | 12/2002 | Lake et al. | |
| 6,553,671 | B2 | 4/2003 | Blanchard | |
| D474,669 | S | 5/2003 | Onion | |
| 6,574,869 | B1 | 6/2003 | McHenry et al. | |
| 6,591,504 | B2 | 7/2003 | Onion | |
| 6,732,436 | B2 * | 5/2004 | Moizis | 30/155 |
| 6,959,494 | B2 * | 11/2005 | Taylor | 30/159 |
| 7,107,686 | B2 * | 9/2006 | Linn et al. | 30/159 |
| 2002/0000042 | A1 | 1/2002 | Glesser et al. | |
| 2002/0157260 | A1 | 10/2002 | Cheng | |
| 2007/0169355 | A1 * | 7/2007 | Lake | 30/160 |

FOREIGN PATENT DOCUMENTS

| | | |
|---|---|---|
| DE | 29469 | 6/1884 |
| DE | 1104386 | 4/1961 |
| FR | 493.741 | 12/1918 |
| FR | 1069862 | 7/1954 |
| FR | 1.171.740 | 4/1957 |
| FR | 1248117 | 10/1960 |
| JP | 52-60500 | 5/1977 |

OTHER PUBLICATIONS

Weyer, J., "Knives Points of Interest Book III", book No. 634 of a limited edition of 5,000, published Sep. 1990, published by Weyer International, Book Division, Toledo, OH/printed in Japan, 5 pgs.

Weyer, J., et al., "Knives Points of Interest Book IV", book No. 935 of a limited edition of 5,000, published Dec. 1993, published by Weyer International, Book Division, Toledo, OH/printed in USA, 7 pgs.

Warner, K., "14th Annual Edition KNIVES '94", 2 pgs.

Blade the Worlds #1 Knife Publication, Nov. 1998, 3 pgs.

Blade the Worlds #1 Knife Publication, Mar. 1999, 4 pgs.

Blade the Worlds #1 Knife Publication, Aug. 1999,.9 pgs.

Blade Magazine Presents TM, "Tek-Knives", Annual 1999, 5 pgs.

Photographs of a knife from Walter Collins, which knife he asserted was constructed and publicly shown in 1995, the photographs having been taken in 2005.

* cited by examiner

FOLDING KNIFE WITH SAFETY LOCK

CROSS-REFERENCE TO RELATED APPLICATION

This application is a continuation of U.S. patent application Ser. No. 09/904,194, filed Jul. 12, 2001 of Kenneth J. Onion, now U.S. Pat. No. 6,591,504, that claims priority to U.S. Design patent application Ser. No. 29/143,656 filed Jun. 18, 2001, the disclosures of which are hereby incorporated by reference. The '194 application also claims priority from and is a continuation-in-part of U.S. patent application Ser. No. 09/750,235, filed Dec. 27, 2000, now U.S. Pat. No. 6,427,334, which claims benefit of U.S. Provisional application No. 60/173,233 filed Dec. 28, 1999. The '194 application also claims priority from and is a continuation-in-part of U.S. patent application Ser. No. 09/591,183, filed Jun. 8, 2000, now U.S. Pat. No. 6,378,214, which claims benefit of U.S. Provisional Patent Application Ser. No. 60/138,318, filed Jun. 9, 1999 and also claims priority from and is a continuation-in-part of U.S. patent application Ser. No. 09/483,075 filed Jan. 14, 2000, now U.S. Pat. No. 6,338,431, which claims benefit of U.S. Provisional application No. 60/130,401, filed Apr. 19, 1999. The disclosures of the '235, the '183, and the '075 applications are hereby incorporated by reference. The '194 application also claims priority from and is a CIP of Ser. No. 09/483,075 filed Jan. 14, 2000 now U.S. Pat. No. 6,338,431, which claims benefit of Provisional application No. 60/130,401, filed Apr. 19, 1999.

BACKGROUND AND SUMMARY OF THE INVENTION

The present invention relates generally to knives, and more particularly to a folding pocket knife with a safety lock to hold a blade of the knife in a closed position. The safety lock is moveably mounted on a handle of the knife, and may slide to a locking position, in which the safety lock prevents the blade from opening out of the handle by obstructing the path of the blade as the blade is urged from a closed position in the handle to an open position out of the handle. The safety lock also may slide away from the locking position, in which the safety lock does not obstruct the path of the blade so that the blade may freely move from the closed position to an open position.

This safety lock is particularly useful in knives having an assisted opening mechanism, such as those disclosed in U.S. Pat. Nos. 5,802,722, 5,815,927, and 6,145,202, the disclosures of which are incorporated herein by reference. An understanding of some prior locking mechanisms for knives also may be obtained from U.S. Pat. Nos. 1,189,005, 1,743,022, 4,133,106, 4,451,982, 4,947,552, 4,974,323, 4,979,301, 5,060,379, 5,092,045, 5,293,690, 5,647,129, and 5,822,866, the disclosures of which are incorporated herein by reference.

The advantages of the present invention will be understood more readily after a consideration of the drawings and the Detailed Description.

DETAILED DESCRIPTION OF THE INVENTION

Figure 1:
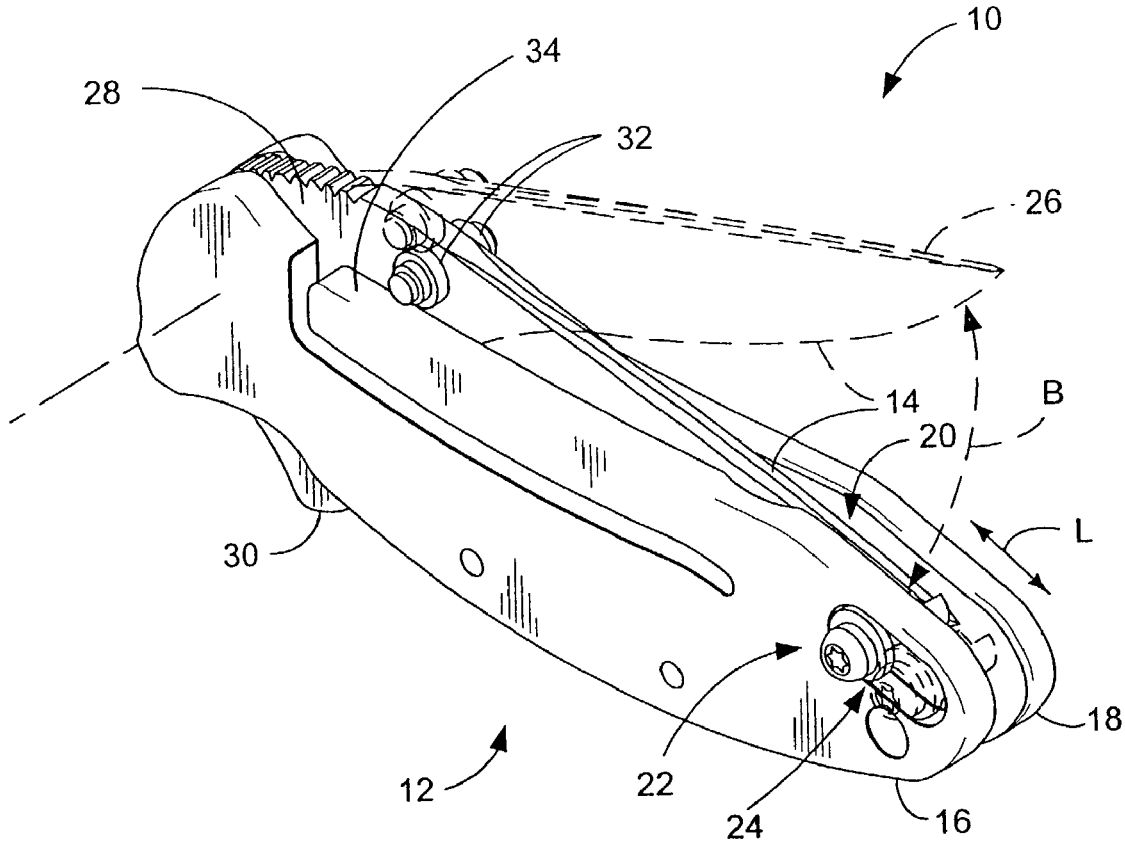
FIG. 1 is an isometric view of a knife according to one embodiment of the present invention, including a blade, a handle, and a safety lock, with the blade shown in solid lines in a closed position and in broken lines in an open position, and with the safety lock shown in solid lines in a locking position and in broken lines in an unlocked position, with arrows demonstrating possible movement of the blade and safety lock.

Referring to the drawings, and more specifically to FIG. 1, a folding knife 10 according to one embodiment of the present invention is shown. Knife 10 includes a handle 12 and a blade 14 pivotally coupled to handle 12, as described in more detail below. Preferably, handle 12 is assembled from a first side piece 16 and a second side piece 18 that define a hollow region 20 for receiving blade 14 when blade 14 is in a closed position relative to handle 12. This closed or folded position is shown in solid lines in FIG. 1.

When blade 14 is in the closed position, a safety lock 22 may slide along a path 24 to a locked position to prevent a distal end 26 of blade 14 from pivoting out of handle 12 to an open position. A solid arrow L shows the preferred movement of safety lock 22. Safety lock 22 may also slide to an unlocked position to allow blade 14 to pivot freely between closed and open positions as indicated by a dashed arrow B.

Blade 14 may further include a tang 28 with a protruding portion 30 located opposite distal end 26, and a thumb stud 32, both elements useful in aiding a user in the opening of knife 10, as described in more detail below. Knife 10 may further include a displaceable lining portion 34 that may lock blade 14 in a fully extended position. This is achieved by a bias that causes lining portion 34 to move into the path of blade 14 once blade 14 has moved to a substantially open position. Closing blade 14 requires moving lining portion 34 out of the path of blade 14. These features are further described in U.S. Pat. Nos. 6,145,202 and 5,802,722.

Figures 2, 3:
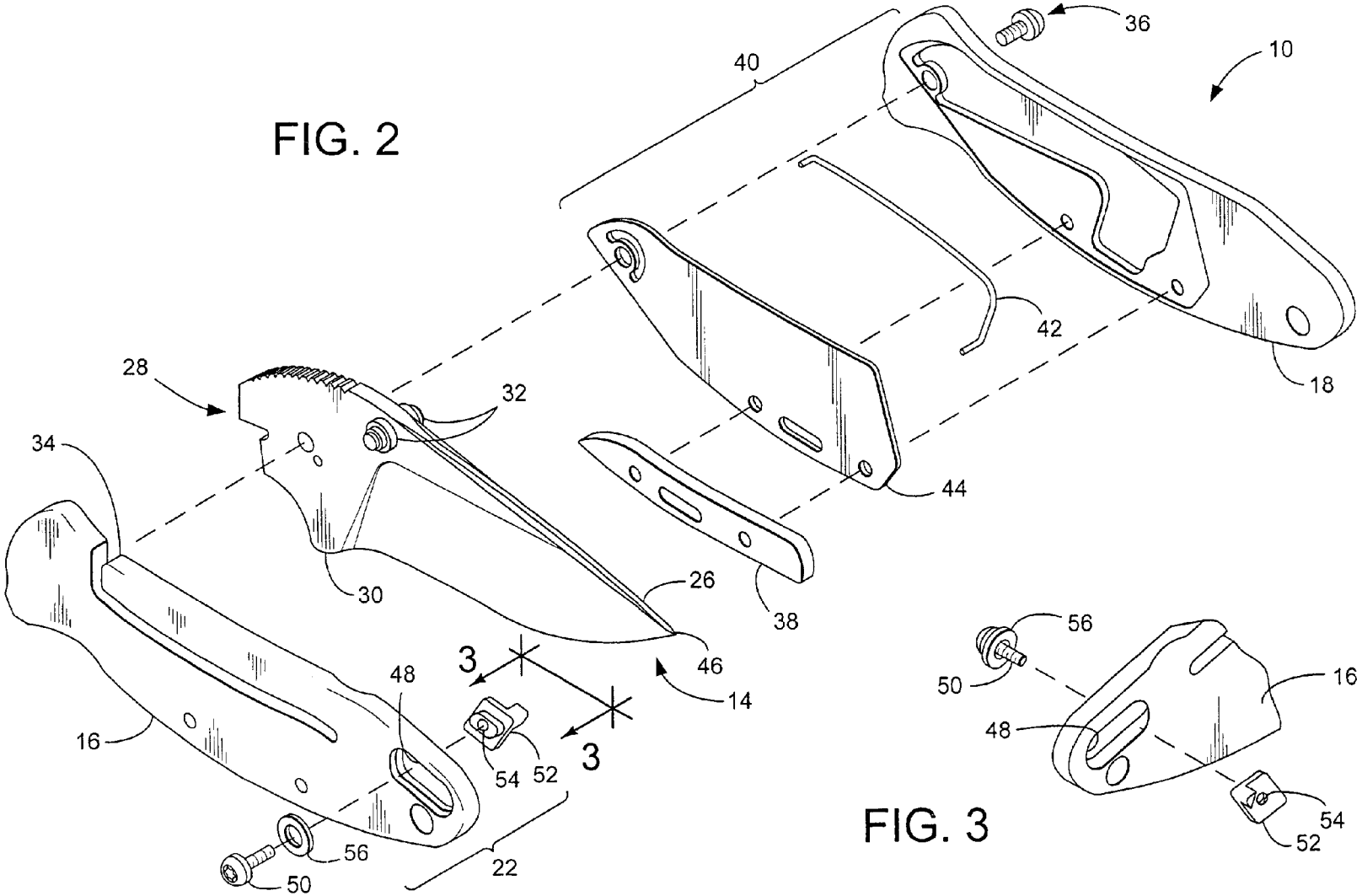
FIG. 2 is an exploded, isometric view of the knife of FIG. 1.
FIG. 3 is an exploded, isometric view of a portion of the knife of FIG. 1, taken along line 3-3 of FIG. 2.
Figure 4:
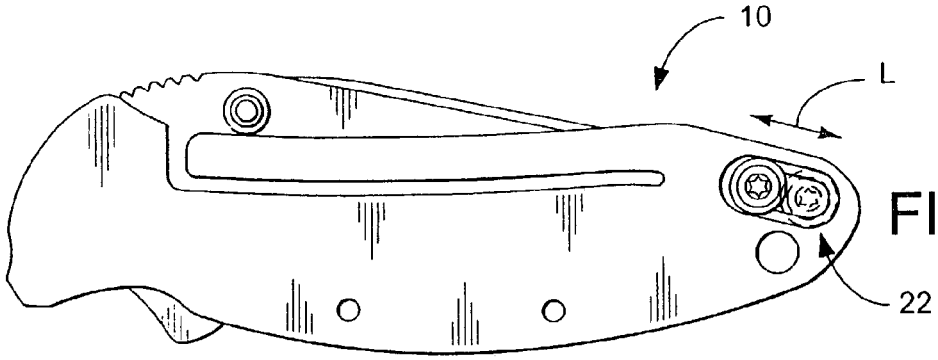
FIG. 4 is a front view of the knife of FIG. 1.
Figure 5:
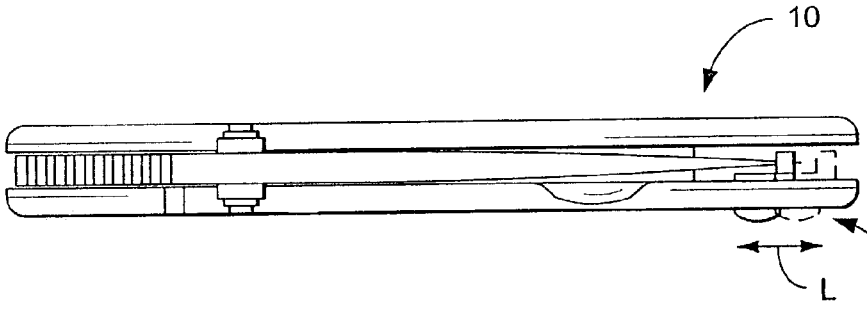
FIG. 5 is a top view of the knife of FIG. 1.
Figure 6:
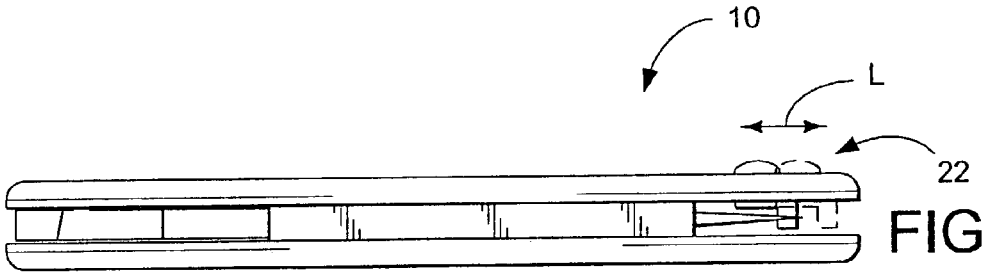
FIG. 6 is a bottom view of the knife of FIG. 1.
Figure 7:
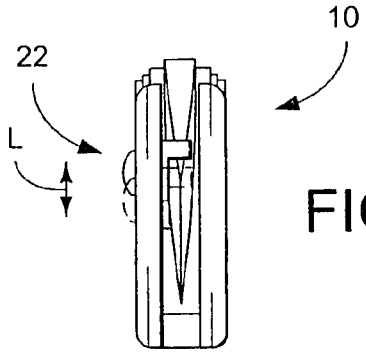
FIG. 7 is an end view of the knife of FIG. 1.

Referring to FIG. 2, the exploded view of knife 10 shows other typical elements of knife 10. Knife 10 includes a pivot pin 36 that allows blade 14 to pivot between open and closed positions and couples side pieces 16 and 18. Knife 10 further includes a spacer 38 that couples side pieces 16 and 18 and together with side pieces 16 and 18, forms hollow region 20 for receiving blade 14, as described above.

Knife 10 may still further include am assisted opening mechanism 40 that aids a user in opening knife 10. Assisted opening mechanism 40 includes a bias element 42 that urges blade 14 toward the fully extended position once blade 14 has been moved a certain distance B from the closed position or past an equilibrium point. The bias element 42 may also be configured to urge the blade 14 toward the closed position while the blade 14 is between the equilibrium point and the closed position. Assisted opening mechanism 40 further includes an internal plate 44 that, along with spacer 38, restricts the movement of one end of bias element 42. Bias element 42 is configured to transmit forces between blade 14 and handle 12 and is a push rod including books on each end, but alternatively may be a plunger, flexible cable, or other suitable force-transmitting element. Assisted opening mechanism 40 is described in detail in U.S. Pat. Nos. 6,145,202 and 5,802,722.

As shown in greater detail in FIG. 2, distal end 26 of blade 14 typically includes a point 46, but may include a blunt end or other tool head. As described above, tang 28 includes a portion 30 configured to protrude from handle 12. This allows a user to open blade 14 from the closed position by pushing protruding portion 30 back into hollow region 20, thereby urging blade 14 past the equilibrium point of assisted opening mechanism 40. Blade 14 also may include a thumb stud 32 located on one or both sides of blade 14, which allows a user to apply a force to stud 32 to extend blade 14. These features are useful in one-handed assisted opening devices and safety lock 22 is particularly useful as a safety precaution with these devices. It will be understood that safety lock 22 may also be used for pocket tools and knives that do not include assisted opening mechanisms.

Referring to FIGS. 2 and 3, safety lock 22 is mounted in a channel or slotted hole 48 located in handle 12. Slotted hole 48 preferably is located near distal end 26 of blade 14. Safety lock 22 is configured to obstruct the path of travel of distal end 26 of blade 14 when preventing blade extension, as described above.

Safety lock 22 preferably includes a bolt 50 configured to attach to a block or latch 52 through slotted hole 48. Block 52 preferably includes a threaded hole 54 to mate with bolt 50. Block 52 typically is constructed of plastic or rubber material to minimize or prevent damage to blade 14 when blade 14 contacts block 52. As long as block 52 of safety lock 22 is obstructing the path of blade 14 or limiting the movement of blade 14, safety lock 22 is operable in preventing the extension of blade 14 and is considered locked.

Safety lock 22 generally is positioned in one of two positions in slotted hole 48 on handle 12. Safety lock 22 is shown in several of the figures in dashed lines in an unlocked or inoperable position, in which the path of blade 14 is unobstructed. Safety lock 22 is shown in all of FIGS. 1-7 in solid lines in a locked or operable position that obstructs the path of blade 14.

The user may adjust safety lock 22 between locked and unlocked positions by sliding bolt 50 along slotted hole 48. Safety lock 22 is held in a user-selected position by friction. The friction may be adjusted by adjusting the tightness of bolt 50. Safety lock 22 may further include a washer 56 between the head of bolt 50 and handle 12 to enhance frictional contact between handle 12 and lock 22.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Figure 8:
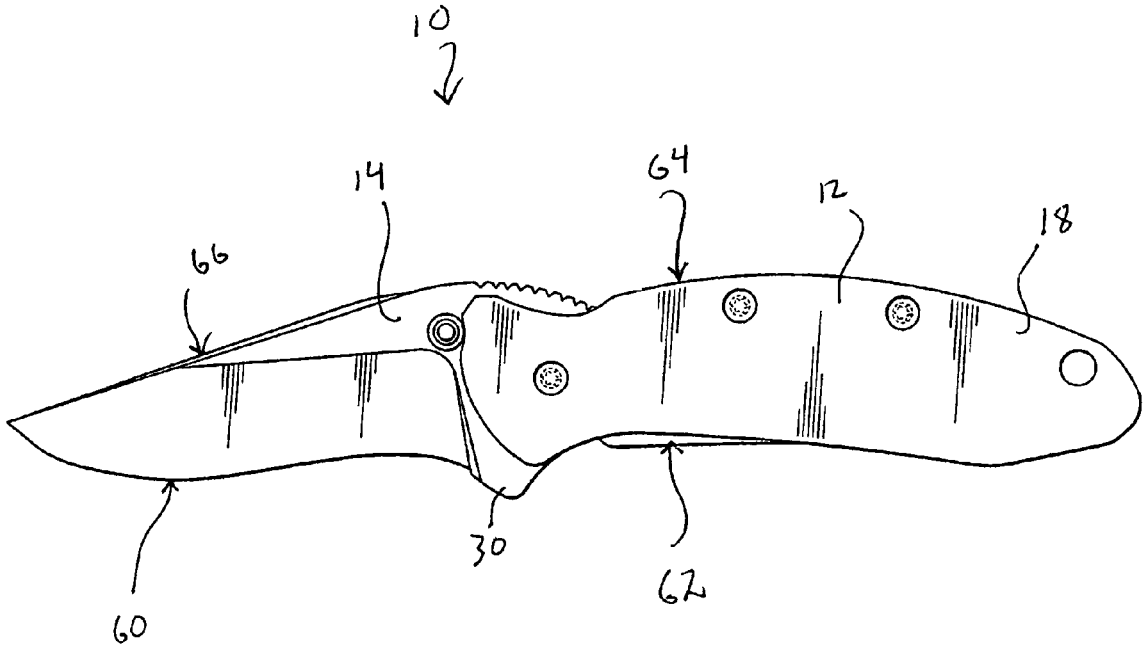
FIG. 8 is a front view of the knife of FIG. 1 in a fully opened position

FIG. 8 shows the folding knife 10 in the open position, with the second side piece 18 visible, the blade 14 comprises a back edge 66 and a front edge that includes a cutting edge 60 and the protruding portion 30. For reference purposes, the bottom portion 62 of the knife, as viewed in figure 8, may be referred to as the front or front edge of the knife, while the top portion 64 may be referred to as the back or back edge of the knife.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A folding knife comprising:

a handle;

a hollow region in the handle;

a blade operatively coupled to the handle and configured to be pivoted into the hollow region in a closed position, the blade including a protruding portion that is sized and positioned on the blade to extend through the hollow region and beyond a back side of the handle when the blade is in the closed position and to be out of the hollow region and extending beyond a front side of the handle when the knife is in an open position;

a safety lock configured to prevent the blade from moving out of the hollow region of the handle; and a bias element operatively attached to the blade and configured to urge the blade toward an extended position once the blade has moved past an equilibrium point;

wherein the protruding portion is configured to be pushed into the hollow region urging the blade past the equilibrium point and into the extended position.

2. A folding knife, comprising:

a handle;

a blade having a front edge and a back edge, the front edge extending a length of the blade and including a cutting edge extending a portion of the length thereof, the blade being coupled at a tang end thereof to the handle and configured to rotate, relative to the handle, between an open position in which a point end of the blade extends away from the handle and a closed position in which at least the cutting edge of the blade is received in the handle, the blade further including a protruding portion extending from the front edge of the blade at the tang end, the protruding portion sized and configured such that, when the blade is in the closed position, the protruding portion protrudes from a back side of the handle to within reach of a user;

wherein the back side extends in the longitudinal direction of the handle; and a bias element configured to bias the blade toward the open position.

3. The folding knife of claim 2 wherein the bias element is configured to bias the blade toward the open position once the blade is rotated from the closed position a selected distance toward the open position.

4. The folding knife of claim 3 wherein the bias element is configured to bias the blade toward the closed position while the blade is less than the selected distance from the closed position.

5. The folding knife of claim 3 wherein the protruding portion of the blade is configured such that, when the blade is in the closed position and the user pushes the protruding portion into the handle, the blade is rotated the selected distance from the closed position.

6. A folding knife, comprising:

a handle;

a blade coupled to the handle and configured to rotate between an open position and a closed position, relative to the handle, the blade including a protruding portion extending from a front edge of the blade and adjacent to a cutting edge of the blade, wherein the cutting edge extends along a portion of the front edge of the blade protruding portion extending beyond the handle when the blade is in the open and the closed positions; and a spring operatively coupled between the handle and the blade and configured to bias the blade toward the open position.

7. The knife of claim 6 wherein the spring is configured to bias the blade toward the open position when the blade is rotated from the closed position past an equilibrium point.

8. The knife of claim 7 wherein the spring is configured to bias the blade toward the closed position while the blade is between the equilibrium point and the closed position.

9. A pocket knife having a blade with a tang and a cutting edge extending along a portion of a front edge of the blade, and a handle into which the blade pivots about a pivot for storage, comprising:

a channel in the handle that receives the blade in a closed position;

an opening extending through a back of the handle between the pivot and the channel;

a protruding portion of the tang extending from the front edge of the blade that is sized to be accessible from the opening in the back of the handle when the blade is stored in the closed position and to be positioned out of the channel and extending beyond a front of the handle when the knife is in an open position; and a spring operatively connected between the blade and the handle to force the blade to pivot toward the open position when the protruding portion of the tang is pushed through the opening into the back of the handle.

10. The pocket knife according to claim 9 wherein the protruding portion extends through the opening in the handle when the blade is in the closed position.

11. The pocket knife according to claim 9 wherein the spring forces the blade to pivot toward then open position when the blade is positioned at an acute angle greater than a predefined acute angle with respect to the handle.

12. The pocket knife according to claim 11 wherein the protruding portion, the opening and the spring are mutually arranged so that a user can pivot the blade to at least the predefined acute angle by pressing the protruding portion through the opening.

13. The pocket knife according to claim 11 wherein the spring does not exert a pivoting force on the blade toward the open position when the blade is positioned at less than the predefined acute angle.

14. The pocket knife according to claim 9 wherein the spring exerts a pivoting force on the blade directed toward the closed position when the blade is positioned at an acute angle less than the predefined acute angle.

15. The pocket knife according to claim 9 including a locking mechanism that retains the blade in the closed position.

16. A spring-assisted pocket knife comprising:

a handle having two side plates attached together so as to provide a channel therein;

a blade pivotally connected to an end of the handle by a pivot pin and having a cutting edge extending a portion of a front edge of the blade, and housed in the channel in a closed position;

a spring that further connects the blade to the handle and is configured to provide a spring force that urges the blade to pivot about the pin with respect to the handle toward an open position; and an exposed portion of an oversized tang of the blade extending from the front edge of the blade and configured to receive a pushing force that urges the blade to pivot about the pin until the spring commences to urge the blade to pivot toward the open position.

17. The spring-assisted pocket knife according to claim 16 wherein the pushing force urges the blade to pivot in a direction opposite to that of the spring force when the blade is positioned at an angle with respect to the closed position that is less than a predetermined acute angle.

18. The spring-assisted pocket knife according to claim 16 wherein the exposed portion is exposed sufficiently through the channel so that the pushing force can pivot the blade past a predetermined acute angle with respect to the closed position so that the spring force causes the blade to pivot through an obtuse angle to the open position.

* * * * *